US006551985B1

(12) United States Patent
Bianchetti et al.

(10) Patent No.: US 6,551,985 B1
(45) **Date of Patent: *Apr. 22, 2003**

(54) ACIDIC LIMESCALE REMOVAL COMPOSITIONS

(75) Inventors: Giulia Ottavia Bianchetti, Rome (IT); Elisabetta L. Russo, Rome (IT); Luigi Pace, Sorrento (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/403,952

(22) PCT Filed: Apr. 24, 1998

(86) PCT No.: PCT/IB98/00641

§ 371 (c)(1),
(2), (4) Date: Aug. 17, 2000

(87) PCT Pub. No.: WO98/49263

PCT Pub. Date: Nov. 5, 1998

(30) Foreign Application Priority Data

Apr. 30, 1997 (EP) ..... 97870056

(51) Int. Cl.[7] ..... C11D 3/34; C11D 3/37; C11D 7/34; B08B 3/04

(52) U.S. Cl. ..... 510/475; 510/197; 510/199; 510/238; 510/362; 510/365; 510/434; 510/477; 134/25.2; 134/25.3; 134/38; 134/39; 134/40; 134/42

(58) Field of Search ..... 510/197, 199, 510/238, 362, 365, 434, 475, 477; 134/25.2, 25.3, 38, 39, 40, 42

(56) References Cited

U.S. PATENT DOCUMENTS

| | | | | |
|---|---|---|---|---|
| 4,581,042 A | | 4/1986 | Willmore | |
| 4,765,921 A | | 8/1988 | Rousset et al. | |
| 4,895,658 A | * | 1/1990 | Amjad | 210/636 |
| 5,601,749 A | | 2/1997 | Hall et al. | |
| 5,981,449 A | * | 11/1999 | Rapisarda et al. | 510/108 |
| 6,333,299 B1 | * | 12/2001 | Pace et al. | 510/238 |

FOREIGN PATENT DOCUMENTS

| | | | | |
|---|---|---|---|---|
| EP | WO 97/06228 | * | 2/1997 | C11D/1/14 |
| EP | 875554 A1 | * | 11/1998 | C11D/3/02 |

* cited by examiner

*Primary Examiner*—Yogendra N. Gupta
*Assistant Examiner*—Brian P. Mruk
(74) *Attorney, Agent, or Firm*—Kevin L. Waugh; Jason J. Camp

(57) ABSTRACT

A liquid acidic composition having a sulfamic acid, a second acid, and an acid-stable polymer selected from the group consisting of a sulphonated polystyrene polymer, a vinylpyrrolidone homopolymer or copolymer, and mixtures thereof, to remove limescale-containing stains from a hard-surface.

35 Claims, No Drawings

ACIDIC LIMESCALE REMOVAL COMPOSITIONS

TECHNICAL FIELD OF THE INVENTION

The present invention relates to acidic hard-surfaces compositions, especially limescale removal compositions.

BACKGROUND OF THE INVENTION

Tap water contains a certain amount of solubilized ions which upon water evaporation eventually deposit as salts such as calcium carbonate on surfaces which are often in contact with water, resulting in an anaesthetic aspect of the surfaces. This limescale formation and deposition phenomenon is even more acute in places where water is particularly hard.

It is well-known in the art that limescale deposits can be chemically removed with acidic solutions, and a great variety of acidic cleaning compositions have been described for this purpose.

However, such limescale removal compositions are perceived by the consumers as being irritant detergent compositions and many consumers suffer from skin irritation when using such compositions.

Particularly, when using such liquid acidic compositions the hands of the user are prone to irritation. This occurs when these compositions are used neat and also when used in diluted form.

Without being limited by theory, it is believed that acids may attack the uppermost layer of the epidermal of the skin and alter the natural pH of the skin. This may result in the decrease of the elasticity of the skin.

The skin also may become more sensitive, resulting in dryness and coarseness of the skin. In addition the skin may become inflamed, red, sore and/or itchy.

It is thus an object of the present invention to improve skin mildness of liquid acidic compositions, especially acidic limescale removal compositions. More particularly, it is an object of the present invention to provide acidic limescale removal compositions which are milder to skin while exhibiting excellent limescale removing performance.

Furthermore, it is also desirable that such liquid acidic compositions should have, in addition to the ability to effectively remove limescale deposits, the ability to provide a good shine to the surfaces they have descaled. However, surface shine is often compromised by the low affinity the hard surface has with water when it comes in contact with it. Indeed, water have the tendency to form droplets on the surface rather than forming a thin film uniformly spread over the surface. This results, as water evaporates, in precipitation of poorly water soluble inorganic salts such as calcium/magnesium carbonate and/or phosphate salts with consequent formation of watermarks on the surface and, eventually, limescale deposits, resulting in anaesthetic aspect of the surface.

It is thus another object of the present invention to improve shine delivered on a surface treated with acidic compositions, especially acidic limescale removal compositions. More particularly, it is another object of the present invention to provide liquid acidic compositions delivering improved shine to the surface treated while exhibiting excellent limescale removing performance.

The present invention overcomes these problems by formulating liquid acidic compositions comprising as the acidic system, sulphamic acid and a second acid, and an acid-stable polymer as described herein after. Indeed, both the shine on the surface treated with the compositions of the present invention and the skin mildness of said compositions is improved while delivering excellent limescale removal performance to the surface treated therewith. Indeed, less skin irritation is perceived by the user when its skin comes into contact with the compositions of the present invention and less formation of watermarks and/or even limescale deposits are observed on a surface having been treated with the compositions of the present invention and later on comes in contact with water, for example, during a rinse operation.

Another advantage of the present invention is that the shine benefit delivered to a hard surface treated with the compositions of the present invention persists even after several cycles of rinsing thus providing long lasting protection against formation of watermarks and/or even limescale deposits on the surface, and hence long lasting shiny surfaces. In other words, the house wife will have the advantage to delay the next descaling operation. Advantageously, the shine benefits herein are obtained at very low levels of acid-stable polymers in the acidic compositions of the present invention.

Another advantage of the liquid acidic compositions of the present invention comprising the acidic system and the acid-stable polymer as described herein is that the surfaces treated become smoother (this can be perceived by touching said surfaces). This may also contribute to convey to consumer perception of surface perfectly descaled.

The compositions according to the present invention may be used on a variety of surfaces including metal surfaces such as aluminium, chromed steel, stainless steel, synthetic materials like vinyl, linoleum, glazed or non-glazed ceramic tiles, and/or enamel surfaces.

BACKGROUND ART

Limescale compositions comprising sulphamic acid are known in the art. EP-A-666 305 discloses acidic limescale removing compositions comprising maleic acid and a second acid like sulphamic acid. However, no acid stable polymers as described herein are disclosed.

JP-63-309596 discloses compositions for hard-surfaces such as food utensils containing at least 10% of surfactants and 0.3% of one or more polystyrene sulphonic acid or salts thereof. The addition of polystyrenesulphonic acid or its salts in a liquid composition for hard-surface which contains a surfactant allows water spots to be prevented. The acidic system according to the present invention is not disclosed.

EP-A-467 472 discloses a hard-surface liquid composition with anti-static/anti-soiling cationic quaternized polymers. Cationic quaternized polymethacrylate include beta (trialkyl ammonium) ethylmethacrylates/acrylates. Also while cationic and anionic polymers are preferred, nonionic polymers can also be used like vinylpyrrolidone polymers, copolymer of methyl vinyl ether and maleic anhydride. The acidic system according to the present invention is not disclosed.

WO 94/26858 discloses acidic compositions (pH 2–8) comprising a nonionic surfactant and an anionic polymer having an average molecular weight less than 1 000 000 said polymer being free of quaternary nitrogen groups. The acidic system of the present invention is not disclosed.

SUMMARY OF THE INVENTION

The present invention relates to a liquid acidic composition suitable for removing limescale-containing stains from a hard-surface, having a pH below 5, and comprising from 0.01% to 20% of the total composition of a sulfamic acid, from 0.01% to 45% by weight of the total composition of a second acid, and from 0.001% to 10% by weight of an acid-stable polymer selected from the group consisting of a polycarboxylate polymer, a sulphonated polystyrene polymer, a vinylpyrrolidone homopolymer or copolymer, a polyalkoxylene glycol, and mixture thereof.

The present invention also encompasses a process of treating hard-surfaces wherein an acidic liquid composition according to the present invention is applied in its neat form or in diluted form, onto said surfaces, then left to act onto said surfaces and then removed by rinsing.

In a broader embodiment, the present invention also encompasses the use of a liquid acidic composition comprising at least an acid (typically an organic or inorganic acid or a mixture thereof as described herein after) and an acid-stable polymer selected from the group consisting of a polycarboxylate polymer, a sulphonated polystyrene polymer, a vinylpyrrolidone homopolymer or copolymer, a polyalkoxylene glycol, and a mixture thereof, to remove limescale-containing stains from a hard-surface, whereby long lasting shine is delivered to said surface after it has been first treated with said composition.

In another broader embodiment, the present invention encompasses the use of a liquid acidic composition comprising at least an acid (typically an organic or inorganic acid or a mixture thereof as described herein after) and an acid-stable polymer selected from the group consisting of a polycarboxylate polymer, a sulphonated polystyrene polymer, a vinylpyrrolidone homopolymer or copolymer, a polyaikoxylene glycol, and mixture thereof, suitable for removing limescale-containing stains from a hard-surface, to reduce the formation of limescale deposits on said hard-surface when it comes in contact with water, after said hard-surface has first been treated with said composition.

DETAILED DESCRIPTION OF THE INVENTION

The Liquid Acidic Compositions:

The liquid compositions of the present invention are acidic compositions. Accordingly, the compositions of the present invention are formulated at a pH below 5, preferably below 4, more preferably at a pH between 0 and 3, even more preferably at a pH between 0.1 and 2.5, even more preferably between 0.1 and 2, and most preferably at a pH between 0.3 and 1.5.

The liquid compositions according to the present invention are preferably aqueous compositions. Therefore, they typically comprise from 50% to 98% by weight of the total composition of water, preferably from 60% to 95% and more preferably from 70% to 90%.

The compositions of the present invention comprise as a first essential feature sulphamic acid. Sulphamic acid may be added in the compositions according to the present invention in its acid form or as an alkali metal salts thereof. Thus sulphamic acid may be added for example as sulphamate. Sulphamic acid is commercially available under the trade name of Sulphamic acid by Albright & Wilson or Nissan chemicals.

Accordingly the compositions of the present invention comprise from 0.01% to 20% by weight of the total composition of sulphamic acid, preferably from 0.1% to 10% and more preferably from 0.1% to 5%.

The compositions according to the present invention comprise as second essential feature a second acid or a mixture thereof. By "second acid" it is meant herein any strong and/or weak organic or inorganic acids known to those skilled in the art with the exception of said sulphamic acid. Indeed, such acids can be used in their acidic form or in the form of their salts (mono-, di-, tri-salts) and in all their anhydrous and hydrated forms, or mixtures thereof. Such acids may typically be used in the form of their alkali metal salts (e.g. sodium salt, potassium salt, and then like) or their alkali hydrogen acid salts. The compositions according to the present invention are designed for removing limescale or soils comprising limescale as an essential component. Thus, the second acid is desired to strengthen the limescale removal performance of sulphamic acid.

Preferably the second acids to be used herein which are particularly efficient to remove limescale on many surfaces, have their first pKa not exceeding 5, more preferably not exceeding 3, and most preferably not exceeding 2. Examples of inorganic acids are sulphonic acid derivatives, maleic acid (pKa=1.83), hydrochloric acid (pKa<0), nitric acid (pKa<0), phosphoric acid (pKa=2.1) and sulphuric acid (pKa=0.4). An example of organic acid is citric acid (pKa=3.06).

Particularly suitable second limescale removing acids to be used according to the present invention are weak acids with a pKa from 5 to 1.5, preferably 3 to 1.5 such as maleic acid. Maleic anhydride is equally convenient for use in the compositions according to the present invention. Indeed, maleic anhydride is generally cheaper than maleic acid and it is transformed into the acid form when incorporated in an aqueous medium.

Other suitable second acids are sulphonic acid derivatives including alkyl sulphonic acids and aryl sulphonic acids.

Suitable alkyl sulphonic acids for use herein are C1–C6 linear or branched alkylsulphonic acids or mixtures thereof, such as methanesulphonic acid (pKa=1.9) commercially available for example from Aldrich, William Blythe & Co. Ltd. or Elf. Atochem.

Suitable aryl sulphonic acids for use herein are according to the formula

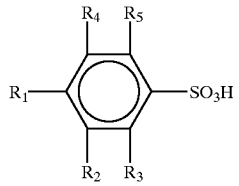

wherein $R_1$, $R_2$, $R_3$, $R_4$ and $R_5$ are each H or $SO_3H$, or linear or branched $C_1$–$C_4$ alkyl chain; or mixtures thereof.

Preferred arylsulphonic acids to be used according to the present invention are those which comprise no or only one alkyl chain. Indeed, such arylsulphonic acids are particularly effective at removing limescale, which is not the case for their longer alkyl chain homologues. Also, such arylsulphonic acids are particularly safe to the surface treated therewith. Particularly suitable arylsulphonic acids for use herein are benzene sulphonic acid (pKa=0.7), toluene sulphonic acid and cumene sulphonic acid. Amongst these three, at equal weight %, the shorter the alkyl chain, down to no chain at all, the better the limescale removing performance.

Preferred second acids to be used herein are maleic acid, sulphuric acid, aryl sulphonic acids, alkyl sulphonic acids, citric acid or mixtures thereof, and more preferred is maleic acid.

The compositions according to the present invention comprise from 0.01% to 45% by weight of the total composition of said second acid or a mixture thereof, preferably from 0.1% to 25%, more preferably 1% to 20% and most preferably from 4% to 18%.

The liquid acidic compositions of the present invention comprise as a third essential feature an acid-stable polymer selected from the group consisting of a polycarboxylate polymer, a sulphonated polystyrene polymer, a vinylpyrrolidone homopolymer or copolymer, a polyalkoxylene glycol, and mixtures thereof.

By "acid-stable", it is meant herein that the polymers according to the present invention allow that the chemical parameters of the acidic composition, e.g. the composition pH and/or the acidity reserve, do not change when the composition is stored in rapid ageing test (RAT) at 50° C. for 6 days.

Suitable polycarboxylate polymers for use herein are polymers comprising monomeric units selected from the group consisting of unsaturated carboxylic acids such as acrylic acid, polycarboxylic acids, sulphonic acids, phosphonic acids and mixtures thereof. Copolymerisation of the above monomeric units among them or with other co-monomers such as maleic anhydride, ethylene or propylene are also suitable. When used, maleic anhydride will acts as a source of additional carboxylic groups, whilst ethylene and propylene will act as diluents.

The molecular weight per carboxylate group of monomers containing a carboxylate group typically varies from 20 to 200, preferably from 40 to 150, more preferably from 50 to 125. Preferred polymers for use herein have a total molecular weight of from 2,000 to 4,500,000, preferably from 10,000 to 4,000,000. Most preferred polymers for use herein contain from 0.5% to 4% by weight of a cross-linking agent, wherein the cross-linking agent tends to interconnect linear strands of the polymers to form the resulting cross-linked products. Suitable cross-linking agents include the polyalkenyl polyethers.

Preferred polycarboxylate polymers for use herein are the polyacrylate polymers. Typically acrylic/maleic-based copolymers may be used as a preferred polyacrylate polymer. Such materials include the water-soluble salts of copolymers of acrylic acid and maleic acid. The average molecular weight of such copolymers in the acid form preferably ranges from about 2,000 to 1,000,000, more preferably from about 5,000 to 100,000, most preferably from about 10,000 to 80,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic/acrylic acid with an average molecular weight of about 70,000. Such copolymers are commercially available from BASF under the trade name Sokalan CP5®.

Other preferred polyacrylate polymers are the copolymer of acrylic acid and alkyl ($C_5$–$C_{10}$) acrylate, commercially available under the tradename Carbopol® 1623, Carbopol® 695 from BF Goodrich. Commercially available polymers of the polyacrylate type further include those sold under the trade names Carbopol®, Acrysol® ICS-1, Polygel®, and Sokalan®.

Two different types of sulfonated polystyrene polymers are useful herein. The first type is a sulfonated homopolymer of styrene. The second type is a sulfonated interpolymer of styrene with an ethylenically unsaturated comonomer. The useful compounds herein include the partially or fully neutralized salts of either the sulfonated polystyrene or the sulfonated styrene interpolymers, i.e. the soluble salts of these polymers, wherein the sulfonic acid groups are partially or fully neutralized.

Suitable ethylenically unsaturated comonomer units which can be copolymerized with styrene to make the interpolymers suitable for sulfation include acrylic and methacrylic esters of aliphatic alcohols such as methyl, ethyl, butyl and 2-ethyl hexyl alcohols, acrylic acid, acrylonitrile, methacrylonitrile, dibutyl maleate, vinylidene chloride and the like. Particularly preferred ethylenically unsaturated monomers for use herein include ethylene, propylene, styrene, vinyl naphthalene, acrylic acid and maleic anhydride.

Sulphonated styrene homopolymers suitable for use herein are commercially available under the trade name Versaflex® from National Starch. Most suitable polymers and copolymers for use herein will be water soluble, and the molecular weight for these polymers is preferably between 5000 and 10,000,000, most preferably between 50,000 and 1,000,000.

Suitable vinylpyrrolidone homopolymers to be used herein are homopolymers of N-vinylpyrrolidone having the following repeating monomer:

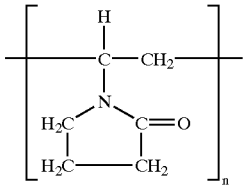

wherein n (degree of polymerisation) is an integer of from 10 to 1,000,000, preferably from 20 to 100,000, and more preferably from 20 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include Sokalan HP 1 650® and Sokalan HP 12®; vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well known monomers may be used.

The molecular weight of the copolymer of vinylpyrrolidone is not especially critical so long as the copolymer is water-soluble, has some surface activity and is adsorbed to the hard-surface from the liquid composition or solution (i.e. under dilute usage conditions) comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000–1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name Luviskol® series from BASF.

The copolymers of vinylpyrrolidone for use in the compositions of the present invention also include quaternized or unquaternized vinylpyrrolidone/dialkylaminoalkyl acrylate or methacrylate copolymers.

Such vinylpyrrolidone/dialkylaminoalkyl acrylate or methacrylate copolymers (quaternised or unquaternised) suitable to be used in the compositions of the present invention are according to the following formula:

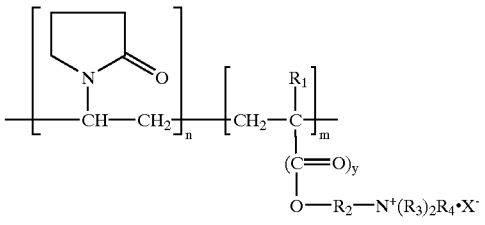

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group of from 1 to 4 carbon atoms, preferably methyl or ethyl, or

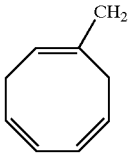

$R_4$ denotes a lower alkyl group of from 1 to 4 carbon atoms, preferably methyl or ethyl; $X^-$ is chosen from the group consisting of Cl, Br, I, $1/2SO_4$, $HSO_4$ and $CH_3SO_3$. The polymers can be prepared by the process described in French Pat. Nos. 2,077,143 and 2,393,573.

The preferred quaternized or unquaternized vinylpyrrolidone/dialkylaminoalkyl acrylate or methacrylate copolymers for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the tradename Luviquat®.

Suitable polyalkoxylene glycols to be used herein have the following formula:

$$H—O—(CH_2—CHRO)_n—H,$$

wherein R is hydrogen or a linear or branched hydrocarbon chain having from 1 to 30 carbon atoms, preferably R is hydrogen, or a linear or branched alkyl group, alkenyl group or aryl group having from 1 to 30 carbon atoms, more preferably from 1 to 16, even more preferably from 1 to 8, and most preferably $R_2$ is methyl, or hydrogen. Preferably n is an integer from 5 to 1000, more preferably from 10 to 100, even more preferably from 25 to 60 and most preferably from 30 to 50.

The preferred polyalkoxylene glycols to be used according to the present invention have a molecular weight of at least 200, more preferably from 400 to 5000 and most preferably from 800 to 3000.

Preferred polyalkoxylene glycols are polyethylene glycols like polyethylene glycol (MW 2000).

Preferred acid-stable polymers to be used herein are the sulphonated polystyrene polymers and/or the vinylpyrrolidone homopolymers.

It has now surprisingly been found that the acid-stable polymers described herein when added into a liquid acidic composition comprising sulphamic acid and another acid deliver improved skin mildness and improved shine while not compromising the limescale removal performance of said composition.

Advantageously, these benefits are obtained at low levels of acid-stable polymers, thus it is yet another advantage of the present invention to provide the desired benefits at low cost. Typically, the liquid acidic compositions according to the present invention comprise from 0.001% to 5% by weight of the total composition of an acid-stable polymer or mixture thereof, preferably from 0.002% to 2%, more preferably from 0.01% to 2% and most preferably from 0.01% to 1%.

Although not wishing to be bound by theory, it has been observed that hard surfaces often have low affinity with water. This means that, when water gets in contact with hard-surfaces, its spreading, which is controlled by the interfacial energy (i.e., solid/liquid surface tension), is very limited. Indeed, it has been observed that the most stable configuration for the water is grouping in spherical droplets rather than forming a thin film uniformly spread over the surface. Then, as water droplets evaporate, their content of salt progressively become higher and higher so that carbonate salts eventually precipitate resulting in watermarks or even limescale deposits. The end result is a reduction of surface shine. It has now been found that when the acid-stable polymers as described herein are added into liquid acidic compositions an hydrophilic layer is left on a hard-surface treated therewith, said hydrophilic layer leaves the water coming in contact with the surface having first been so treated (e.g., water which is used to rinse off the surfaces having been so treated) uniformly spread over the surface ("sheeting effect") instead of forming droplets. This way, the formation of watermarks and/or limescale deposits upon drying is reduced or even eliminated.

Furthermore, it has surprisingly been found that the acid-stable polymers of the present invention have not only the ability to adhere on a surface treated with the acidic compositions of the present invention comprising the same but to still remain adhered on the surface even after several cycles of rinsing (e.g., when water comes onto this surface later on for example in a sink during daily household operation), thus providing long lasting protection against formation of watermarks and/or deposition of limescale deposits, hence, long lasting shiny surfaces.

Thus in a broadest embodiment, the present invention encompasses the use of a liquid acidic composition comprising at least an acid or a mixture thereof, typically an organic or inorganic acid or a mixture thereof and an acid-stable polymer as described herein, suitable for removing limescale-containing stains from a hard-surface, to reduce the formation of limescale deposits on said hard-surface when it comes in contact with water, after said hard-surface has been first treated with said composition. In another broad embodiment, the present invention further encompasses the use of such an acidic composition to remove limescale-containing stains from a hard-surface, whereby long lasting shine is delivered to said surface after it has been first treated with said composition.

Not to be bound by theory, it is believed that the acid-stable polymers also has the ability to form a film on the surface of the user skin thereby further contributing to the skin mildness characteristics delivered due to the presence of sulphamic acid on top of another acid otherwise perceived to be more irritant to skin, e.g. maleic acid.

An additional advantage related to the use of acid-stable polymers of present invention is that, as they adhere on hard surface making them more hydrophilic, the surfaces themselves become smoother (this can be perceived by touching said surfaces) and this contribute to convey perception of surface perfectly descaled.

Optional Ingredients

The compositions according to the present invention may further comprise a variety of other ingredients including surfactants, colorants, bactericides, thickeners, dyes, chelants, pigments, solvents, stabilizers, perfumes, corrosion inhibitors and the like.

Surfactants

A highly preferred optional ingredient suitable to be used in the compositions of the present invention is a surfactant or a mixture thereof. Surfactants are desired herein as they contribute to the cleaning benefits of the limescale removal compositions of the present invention. Indeed, the presence of a surfactant allows to boost the greasy soap scum cleaning of the compositions herein. More generally, the presence of a surfactant in the liquid acidic compositions according to the present invention allows to lower the surface tension and to improve the wettability of the surfaces being treated with the liquid acidic compositions of the present invention. The presence of a surfactant or a mixture thereof in the liquid acidic compositions of the present invention helps to solubilize the soils.

Accordingly the compositions according to the present invention may comprise a surfactant or a mixture thereof. The compositions according to the present invention may comprise up to 40% by weight of the total composition of said surfactant or a mixture thereof, more preferably from 0.05% to 15%, even more preferably from 0.1% to 10%, and most preferably from 0.1% to 5%. All types of surfactants may be used in the present invention including nonionic, anionic, cationic, zwitterionic or amphoteric surfactants. It is also possible to use mixtures of such surfactants without departing from the spirit of the present invention.

Highly preferred surfactants to be used herein are zwitterionic surfactants. Indeed, they have the ability when added in the acidic compositions of the present invention to maintain the limescale removal performance of the acidic system (i.e. similar limescale removing performance as compared to the same acidic compositions but without any surfactant), while providing excellent grease soap scum cleaning ability to the compositions of the present invention.

Suitable zwitterionic surfactants to be used herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

A generic formula for preferred zwitterionic surfactants to be used herein (i.e., betaine and/or sulfobetaine) is $$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group, preferably sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a—C(O)—NR_b—(C(R_c)_2)_m$, wherein $R_a$ is an aliphatic or aromatic, saturated or unsaturated, substituted or unsubstituted hydrocarbon chain containing from 8 up to 20 carbon atoms, preferably an alkyl group containing from 8 up to 20 carbon atoms, preferably up to 18, more preferably up to 16, $R_b$ is either a hydrogen a short chain alkyl or substituted alkyl containing from 1 to 4 carbon atoms, preferably a group selected from the group consisting of methyl, ethyl, propyl, hydroxy substituted ethyl or propyl and mixtures thereof, more preferably methyl or hydrogen, $R_c$ is selected from the group consisting of hydrogen and hydroxy groups, and m is from 1 to 4, preferably from 2 to 3, more preferably 3, with no more than one hydroxy group in any $(C(R_c)_2)$ moiety.

Preferred $R_2$ is hydrogen, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_3$ is a $C_1$–$C_4$ carboxylic acid group, a C1–C4 sulfonate group, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265® Lauryl betaine is commercially available from Albright & Wilson under the trade name Empigen BB/L®.

A further example of betaine is Lauryl-imminodipropionate commercially available from Rhone-Poulenc under the trade name Mirataine H2C-HA®.

Particularly preferred zwitterionic surfactants to be used in the acidic compositions of the present invention are the sulfobetaine surfactants as they deliver optimum limescale removal benefits and soap scum cleaning benefits.

Examples of particularly suitable sulfobetaine surfactants include tallow bis(hydroxyethyl) sulphobetaine, cocoamido propyl hydroxy sulfobetaines which are commercially available from Rhone Poulenc and Witco, under the trade name of Mirataine CBS® and Rewoteric AM CAS 15® respectively.

Further examples of amidobetaines/amidosulfobetaine include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine" .

Suitable amine oxides to be used herein are according to the following formula $R_1R_2R_3NO$ wherein each of R1, R2 and R3 is independently a saturated or unsaturated, substituted or unsubstituted, linear or branched alkyl groups containing from 1 to 30 carbon atoms, and preferably from 1 to 20 carbon atoms. Particularly preferred amine oxides to be used according to the present invention are amine oxides having the following formula $R_1R_2R_3NO$ wherein R1 is a saturated or unsaturated, substituted or unsubstituted, linear or branched alkyl group containing from 1 to 30 carbon atoms, preferably from 8 to 20 carbon atoms, more preferably from 6 to 16, most preferably from 8 to 14, and wherein R2 and R3 are independently substituted or unsubstituted, linear or branched alkyl groups containing from 1 to 4 carbon atoms, preferably from 1 to 3 carbon atoms, and more preferably are methyl groups, or mixtures thereof.

Suitable amine oxides for use herein are for instance coconut dimethyl amine oxides, C12–C16 dimethyl amine oxides. Said amine oxides may be commercially available from Hoechst, Stephan, AKZO (under the trade name Aromox®) or FINA (under the trade name Radiamox®).

Suitable amines to be used herein are according to the following formula RR'R"N wherein R is a saturated or unsaturated, substituted or unsubstituted, linear or branched alkyl groups containing from 1 to 30 carbon atoms, and preferably from 1 to 20 carbon atoms and wherein R' and R" are independently saturated or unsaturated, substituted or unsubstituted, linear or branched alkyl groups containing from 1 to 30 carbon atoms or hydrogen. Particularly preferred amines to be used according to the present invention are amines having the following formula RR'R"N wherein R is a saturated or unsaturated, linear or branched alkyl group containing from 1 to 30 carbon atoms, preferably from 8 to 20 carbon atoms, more preferably from 6 to 16, most preferably from 8 to 14 and wherein R' and R" are independently substituted or unsubstituted, linear or branched alkyl groups containing from 1 to 4 carbon atoms, preferably from 1 to 3 carbon atoms, and more preferably are methyl groups, or mixtures thereof.

Suitable amines for use herein are for instance C12 dimethyl amine, coconut dimethyl amine, C12–C16 dimethyl amine. Said amines may be commercially available from Hoechst under the trade name Genamin®, AKZO under the trade name Aromox® or Fina under the trade name Radiamine®.

Suitable quaternary ammonium surfactants to be used herein are according to the formula $R_1\ R_2R_3R_4N^+X^-$, wherein X is a counteranion such as halogen, methyl sulphate, methyl sulphonate, or hydroxide, $R_1$ is a saturated or unsaturated, substituted or unsubstituted, linear or branched alkyl group containing from 1 to 30 carbon atoms, preferably from 12 to 20, more preferably from 8 to 20 and $R_2$, $R_3$ and $R_4$ are independently hydrogen, or saturated or unsaturated, substituted or unsubstituted, linear or branched alkyl groups containing from 1 to 4 carbon atoms, preferably from 1 to 3 and more preferably methyl. In highly preferred quaternary ammonium surfactants herein $R_1$ is a $C_{10}$–$C_{18}$ hydrocarbon chain, most preferably $C_{12}$, $C_{14}$, or $C_{16}$, and $R_2$, $R_3$ and $R_4$ are all three methyl, and X is halogen, preferably bromide or chloride, most preferably bromide.

Examples of quaternary ammonium surfactants are myristyl trimethylammonium methyl sulphate, cetyl trimethylammonium methyl sulphate, lauryl trimethyl ammonium bromide, stearyl trimethyl ammonium bromide (STAB), cetyl trimethyl ammonium bromide (CTAB) and myristyl trimethyl ammonium bromide (MTAB). Highly preferred herein are lauryl trimethyl ammonium salts. Such trimethyl quaternary ammonium surfactants may be commercially available from Hoechst, or from Albright & Wilson under the trade name Empigen CM®.

In a preferred embodiment, the surfactant used in the acidic compositions of the present invention is a surfactant system comprising a zwitterionic surfactant with a second surfactant, e.g. an amine oxide and/or amine and/or a quaternary ammonium surfactant as described herein at a weight ratio of the zwitterionic surfactant to the second surfactant of at least 1:1, preferably at least 2:1. This surfactant system provides to the acidic compositions according to the present invention both optimum limescale removing performance (i.e, comparable to the limescale removing performance of the same compositions without any surfactant) as well as optimum greasy soap scum cleaning performance.

Suitable nonionic surfactants to be used herein are alkoxylated alcohol nonionic surfactants which can be readily made by condensation processes which are well-known in the art. However, a great variety of such alkoxylated alcohols, especially ethoxylated and/or propoxylated alcohols is also conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from 2 to 24 carbon atoms, e is ethylene oxide and p is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol® or from Shell under the trade name Lutensol®. These nonionics are preferred because they have been found to allow the formulation of a stable product without requiring the addition of stabilisers or hydrotopes.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water- soluble salts or acids of the formula $RSO_3M$ wherein R is an aryl, preferably a benzyl, substituted by a $C_6$–$C_{20}$ linear or branched saturated or unsaturated alkyl group, preferably a $C_{12}$–$C_{18}$ alkyl group and more preferably a $C_{14}$–$C_{16}$ alkyl group, and M is H or a cation, e.g., an alkali metal cation (e.g., sodium, potassium, lithium, calcium, magnesium etc) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "secondary C6–C20 alkyl or C6–C20 alkyl aryl sulphonates", it is meant herein that in the formula as defined above, the SO3M or aryl-SO3M group is linked to a carbon atom of the alkyl chain being placed between two other carbons of the said alkyl chain (secondary carbon atom).

An example of a C14–C16 alkyl sulphonate is Hostapur ® SAS available from Hoechst. An example of commercially available alkyl aryl sulphonate is Lauryl aryl sulphonate from Su.Ma. Particularly preferred alkyl aryl sulphonates are alkyl benzene suiphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 15 carbon atoms in the alkyl group. M is H or a cation, e.g., an alkali metal cation (e.g., sodium, potassium, lithium, calcium, magnesium etc) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl alkoxylated sulphate surfactants for use herein are according to the formula $RO(A)_mSO_3M$ wherein R is an unsubstituted $C_6$–$C_{20}$ alkyl or hydroxyalkyl group having a $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Suitable $C_6$–$C_{20}$ alkyl alkoxylated linear or branched diphenyl oxide disulphonate surfactants for use herein are according to the following formula:

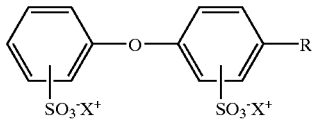

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and $X^+$ is H or a cation, e.g., an alkali metal cation (e.g., sodium, potassium, lithium, calcium, magnesium etc). Particularly suitable C6–$C_{20}$ alkyl alkoxylated linear or branched diphenyl oxide disulphonate surfactants to be used herein are the C12 branched di phenyl oxide disulphonic acid and C16 linear di phenyl oxide disulphonate sodium salt respectively commercially available by DOW under the trade name Dowfax 2A1® and Dowfax 83900®.

Other anionic surfactants useful herein include salts (including, for example, sodium, potassium, ammonium, and substituted ammonium salts such as mono-, di- and triethanolamine salts) of soap, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated C6–C14 diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec.

30, 1975 to Laughlin, et al. at Column 23, line 58 through Column 29, line 23.

Preferred anionic surfactants herein include the primary and secondary $C_6$–$C_{20}$ alkyl suplonates and the primary and secondary $C_6$–$C_{20}$ alkyl aryl sulphonates or a mixture thereof.

Dyes

The liquid compositions according to the present invention may be colored. Accordingly, they may comprise a dye or a mixture thereof.

Suitable dyes to be used herein are acid-stable dyes. By "acid-stable" it is meant herein a compound which is chemically and physically stable in the acidic environment of the compositions herein. Suitable dyes to be used herein include α or β metal phthalocyanines and/or trimethyl methane dyes.

The α or β metal phthalocyanine dyes suitable to be used in the compositions of the present invention are light-fast organic pigments with four isoindole groups, $(C_6H_4)C_2N$, linked by four nitrogen atoms to form a conjugated chain. Their general structure is the following:

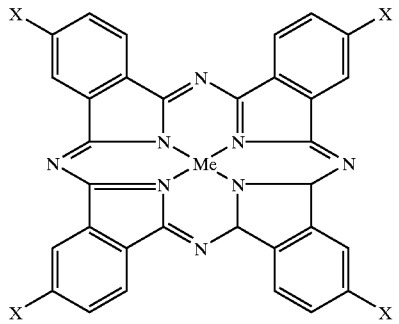

where the substituent X may be one of the following groups: H, Cl, $HSO_3$, COO—M+, Br, $NO_2$, $OCH_3$ or a $C_1$ to $C_{10}$ alkyl group and where Me is copper, chromium, vanadium, magnesium, nickel, platinum, aluminium, cobalt, lead, barium or zinc. Preferred α or β metal phthalocyanine dyes to be used herein are α or β copper phthalocyanine dyes.

Examples of such α copper phthalocyanine dyes to be used herein are copper phthalocyanine (X=H, blue colour) commercially available under the name UNISPERSE Blue B-E® from Ciba-Geigy, or Cosmenyl blue A2R® from Hoechst, or Pigmasol blue 6900® from BASF, or chlorinated copper phthalocyanine (X=Cl, green colour) commercially available under the name Pigmasol Green 8730® from BASF.

Examples of trimethyl methane dyes are commercially available from Hoescht under the name Vitasyn® or from BASF under the name Acid Blue®.

Typically, the compositions of the present invention may comprise up to 0.2% by weight of the total composition of a dye or a mixture thereof, preferably from 0.0001% to 0.015% and more preferably from 0.001% to 0.010%.

Packaging form of the Liquid Acidic Compositions:

The liquid acidic compositions of the present invention may be packaged in a variety of suitable detergent packaging known to those skilled in the art.

Another advantage of the present invention is that the acidic liquid compositions of the present invention comprising the acidic system and the acid-stable polymer herein may be easily dispensed onto the surface to be treated via a spray-type dispenser such as for instance a trigger-sprayer. Accordingly, the present invention also encompasses liquid compositions of the invention packaged in a spray dispenser, preferably in a trigger spray dispenser or in a pump spray dispenser.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® or T 8900® commercially available from Continental Spray International or T 8100® commercially available from Canyon, Northen Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e. to help the formation of liquid droplets.

A further advantage of the present invention is that the acidic liquid compositions of the present invention may be applied uniformly to a relatively large area of a surface to be treated via a spray-type dispenser, thereby ensuring improved limescale removal performance and improved greasy soap scum cleaning performance.

Process for Treating Surfaces:

The compositions according to the present invention are particularly suitable for treating hard-surfaces soiled by limescale-containing stains. By "limescale-containing stains" it is meant herein any pure limescale stains, i.e., any stains composed essentially of mineral deposits as well as limescale-containing stains typically found, for example, in a kitchen or in a bathroom, i.e., stains which contain not only mineral deposits like calcium and/or magnesium carbonate but also soap scum (e.g., calcium stearate) and other grease (e.g. body grease). Actually, the compositions of the present invention exhibit excellent limescale removing performance when used to treat any types of surfaces soiled by limescale-containing stains comprising not only pure limescale deposits but also at least 10% by weight of the total stain of organic deposits like soap scum and grease, preferably more than 30%. Such surfaces can be found in bathrooms, kitchens, but also in appliances including large appliances such as automatic dish washers and/or washing machines.

Accordingly, the present invention encompasses a process of treating hard-surfaces soiled by limescale-containing stains wherein an aqueous acidic liquid composition according to the present invention is applied in its neat form or in diluted form, onto said surfaces, then left to act onto said surfaces and then removed by rinsing.

The expression "used in diluted form" herein includes dilution by the user. Typical dilution levels are of from 0.5% to 50% by weight of the composition.

The expression "treating" includes removing limescale deposits while being safe to the surfaces treated and optionally cleaning greasy soap scum stains especially when surfactants are present.

Limescale Removal Performance Test Method:

The limescale removal capacity of a composition according to the present invention may be evaluated by soaking a marble block (marble blocks are chemically speaking very similar to limescale, i.e. they are essentially made of calcium carbonate) into 20 g of this composition. The marble is weighed before and after the experiment, and the performance is expressed in grams of marble block dissolved over time. Alternatively, limescale removal performance can also be evaluated by detecting the release of CO2.

Greasy Soap Scum Cleaning Performance Test Method:

In this test method enamel white tiles (typically 24 cm*4 cm) are covered with typical greasy soap scum soils mainly based on calcium stearate and artificial body soils commercially available (e.g. 0.3 grams with a sprayer). The soiled tiles are then dried in an oven at a temperature of 140° C. for 30 minutes and then aged overnight at room temperature (around 15° C.–20° C.). Then the soiled tiles are treated with a Spontex® sponge impregnated with the liquid acidic composition of the present invention (e.g. 5 grams). The ability of the composition to remove greasy soap scum is measured through the number of strokes needed to perfectly clean the surface. The lower the number of strokes, the higher the greasy soap scum cleaning ability of the composition.

Shine Test Method:

Obtaining a good shine end result results from a good spreading of a liquid composition over the surface when the surface is treated therewith and from the reduced formation of watermarks and reduced precipitation of poorly water soluble salts when water evaporates. The ability of a composition to provide "shine" to the surface refers to the composition's ability to leave no watermarks after evaporation of water. This can be evaluated by human visual grading.

In a suitable test method two rectangular areas (10 cm×4 cm) of a sink (made of either stainless steel or ceramic) are treated with a composition according to the present invention and a reference composition, e.g. the same composition but without said polymer. 3 grams of composition is first poured onto each surfaces to be treated and, then wiped (10 strokes) by using a Spontex® sponge. Then each treated surface is rinsed with 200 grams of tap water and left to dry. After the surfaces treated with the compositions according to the present invention and those treated with the reference composition get dried, they are compared side by side and evaluated by visual grading to evaluate shine difference. Evaluation may be generally done by applying the Panel Score Unit (PSU).

In a long lasting shine test method the test method as mentioned above may be carried out, but the rinsing and drying cycle are repeated several times. Each time, after both the surfaces get dried they are compared side by side and evaluated by visual grading to see shine difference. Evaluation is generally done by applying the Panel Score Unit (PSU).

The present invention is further illustrated by the following examples.

EXAMPLES

These compositions were made comprising the listed ingredients in the listed proportions (weight %).

| Ingredients: (% by weight) | I | II | III | IV | V | VI |
|---|---|---|---|---|---|---|
| Maleic acid | 10 | 10 | — | — | — | 10 |
| Sulphamic acid | 2 | 2 | 2 | 2 | 2 | 2 |
| Citric acid | — | — | 2 | 2 | 2 | 2 |
| Mirataine CBS ® | 2.0 | 2.0 | — | 2.0 | — | 2.0 |
| Rewoteric AM CAS 15 ® | — | — | — | — | — | — |
| HLAS (*) | — | — | — | — | 0.50 | — |
| Polystyrene Sulphonate | 0.03 | 0.01 | 0.05 | 0.03 | 0.04 | 0.05 |
| Waters & Minors | up to 100 | | | | | |

-continued

| Ingredients: (% by weight) | VII | VIII | IX | X | XI | XII |
|---|---|---|---|---|---|---|
| Maleic acid | 8 | 10 | 12 | — | — | — |
| Sulphamic acid | 2 | 2 | 2 | 2 | 2 | 2 |
| Citric acid | — | 1 | — | 6 | 6 | 8 |
| Mirataine CBS ® | — | — | — | — | — | — |
| Rewoteric AM CAS 15 ® | 2 | — | 2 | — | — | 2.2 |
| HLAS (*) | — | — | — | — | 0.50 | — |
| Polyvinyl pyrrolidone | 0.03 | 0.05 | 0.05 | 0.06 | 0.05 | 0.05 |
| Waters & Minors | up to 100 | | | | | |

| Ingredients: (% by weight) | XIII | XIV | XV | XVI | XVII | XVIII |
|---|---|---|---|---|---|---|
| Maleic acid | — | 10 | — | — | — | 10 |
| Sulphamic acid | 2 | 2 | 1 | 2 | 2 | 2 |
| Citric acid | — | — | 1 | 6 | 6 | — |
| Mirataine CBS ® | — | — | 1 | — | — | — |
| Rewoteric AM CAS 15 ® | 2 | — | 1 | — | — | 2.2 |
| Polyethyleneglycol (MW 2000) | — | 0.05 | — | — | 0.50 | 0.1 |
| Sokalan CP5 ® | 0.05 | — | 0.05 | 0.1 | — | — |
| Waters & Minors | up to 100 | | | | | |

Mirataine CBS ® and Rewoteric AM CAS ® 15 are cocoamidopropyl hydroxy sulphobetaines supplied respectively by Rhone-Poulenc and Witco.

(*) HLAS is Linear alkyl benzene sulphonate in acid form while Na LAS is its sodium salt.

Sokalan CP5 ® is a polyacrylate polymer commercially available from BASF.

All the compositions of the above examples exhibit excellent immediate and long lasting shine benefits on the surface treated while providing excellent limescale removal performance and being mild to the skin of the user when it eventually comes into contact with it. Also the redeposition of limescale deposits on a hard-surface that has been first treated with one of the compositions exemplified above, is reduced or even prevented, when said surface comes again in contact with water, upon prolonged period of time, this both when used neat or in diluted form.

What is claimed is:

1. A liquid acidic composition suitable for removing limescale-containing stains from a hard-surface having a pH below 5, and comprising from 0.01% to 20% of the total composition of a sulfamic acid, from 0.01% to 45% by weight of the total composition of a second acid, and from 0.001% to 10% by weight of an acid-stable polymer selected from the group consisting of a sulphonated polystyrene polymer, a vinylpyrrolidone homopolymer or copolymer, and mixtures thereof.

2. A composition according to claim 1 wherein said second acid is selected from the group consisting of a weak acid, strong acid, organic acid, inorganic acid, and mixtures thereof.

3. A composition according to claim 1 which comprises from about 0.1% to about 10% by weight of the total composition of sulphamic acid.

4. A composition according to claim 3 which comprises from about 0.1% to about 5% by weight of the total composition of sulphamic acid.

5. A composition according to claim 1 which comprises from about 0.1% to about 25% by weight of the second acid.

6. A composition according to claim 5 which comprises from about 1% to about 20% by weight of the second acid.

7. A composition according to claim 5 which comprises from about 4% to about 18% by weight of the second acid.

8. A composition according to claim 1 wherein said acid-stable polymer is selected from the group consisting of a sulphonated homopolymer of (poly) styrene, a sulphonated copolymer of styrene with an ethylenically unsaturated comonomer, and mixtures thereof.

9. A composition according to claim 1 wherein said acid-stable polymer further comprises a polyacrylate polymer, selected from the group consisting of a copolymer of acrylic acid, a copolymer of maleic acid, and mixtures thereof, having an average molecular weight in the acid form of from about 2,000 to about 1,000,000 and a ratio of acrylate to maleate segments in said copolymer which varies from about 30:1 to about 1:1.

10. A composition according to claim 1 wherein said acid-stable polymer further comprises a polyalkoxylene glycol according to the formula $H—O—(CH_2—CHRO)_n—H$, wherein R is hydrogen, or a linear or branched alkyl group, alkenyl group or aryl group having from about 1 to about 30 carbon atoms, and n is an integer from about 5 to about 1000.

11. A composition according to claim 1 wherein said acid-stable polymer is a homopolymer of N- vinylpyrrolidone having the following repeating monomer:

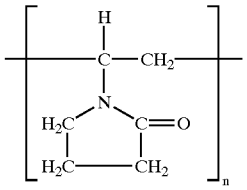

wherein n is an integer of from about 10 to about 1,000,000.

12. A composition according to claim 1 which comprises from about 0.001% to about 5% by weight of the total composition of an acid-stable polymer or mixture thereof.

13. A composition according to claim 12 which comprises from about 0.002% to about 2% by weight of the total composition of an acid-stable polymer or mixture thereof.

14. A composition according to claim 12 which comprises from about 0.01% to about 1% by weight of the total composition of an acid-stable polymer or mixture thereof.

15. A composition according to claim 1 which further comprises up to a level of about 40% by weight of the total composition a surfactant selected from the group consisting of anionic, nonionic, cationic, amphoteric, zwitterionic surfactants, and mixtures thereof.

16. A composition according to claim 1 wherein said composition has a pH below 4.

17. A composition according to claim 16 wherein said composition has a pH of from about 0.1 to about 2.5.

18. A composition according to claim 16 wherein said composition has a pH of from about 0.1 to about 2.

19. A composition according to claim 2 wherein said second acid has its first pKa not exceeding 5.

20. A composition according to claim 2 wherein said second acid is selected from the group consisting of maleic acid, alkylsulfonic acid, arylsulfonic acid, citric acid, nitric acid, sulphuric acid, phosphoric acid, hydrochloric acid, and mixtures thereof.

21. A composition according to claim 8 wherein said acid-stable polymer has a molecular weight of from about 5000 to about 10,000,000.

22. A composition according to claim 9 wherein said ratio of acrylate to maleate segments in said copolymer varies from about 10:1 to about 2:1.

23. A composition according to claim 10 wherein said linear or branched alkyl group alkenyl group or aryl group has from about 1 to about 16 carbon atoms.

24. A composition according to claim 10 wherein said n is an integer from about 10 to about 100.

25. A composition according to claim 23 wherein said linear or branched alkyl group, alkenyl group or aryl group has from about 1 to about 8 carbon atoms.

26. A composition according to claim 11 wherein n is an integer of from about 20 to about 100,000.

27. A composition according to claim 11 wherein n is an integer of from about 20 to about 10,000.

28. A composition according to claim 11 wherein said acid-stable polymer is a copolymer of N-vinylpyrrolidone and alkylenically unsaturated monomer selected from the group consisting of maleic acid, chloromaleic acid, fumaric acid, itaconic acid, citraconic acid, phenylmaleic acid, aconitic acid, acrylic acid, N-vinylimidazole, vinyl acetate, and anhydrides thereof, styrene, sulphonated styrene, alpha-methyl styrene, vinyl toluene, t-butyl styrene, and mixtures thereof.

29. A composition according to claim 5 wherein said surfactant is at least a zwitterionic surfactant according to the formula:

$$R_1—N^+(R_2)(R_3)R_4X^-$$

wherein $R_1$ is an aliphatic or aromatic saturated or unsaturated, substituted or unsubstituted hydrocarbon chain that can contain linking groups selected from the group consisting of an amido group, ester group, alkyl group, and mixtures thereof containing from about 1 to about 24 carbon atoms, or an amido radical of the formula $R_a—C(O)—NR_b—(C(R_c)_2)_m$, wherein $R_a$ is an aliphatic or aromatic, saturated or unsaturated, substituted or unsubstituted hydrocarbon chain containing from about 8 up to about 20 carbon atoms, $R_b$ is either a hydrogen, a short chain alkyl or substituted alkyl containing from about 1 to about 4 carbon atoms, $R_c$ is selected from the group consisting of hydrogen and hydroxy groups, and m is from about 1 to about 4; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is an alkylene, hydroxy alkylene, or polyalkoxy group containing from about 1 to about 10 carbon atoms; and X is the hydrophilic group which is selected from the group consisting of a carboxylate, sulfonate, and mixtures thereof.

30. A composition according to claim 29 wherein said linking group of $R_1$ is an alkyl group containing from about 8 to about 18 carbon atoms.

31. A composition according to claim 29 wherein said $R_b$ is selected from the group consisting of methyl, ethyl, propyl, hydroxy substituted ethyl or propyl, and mixtures thereof.

32. A composition according to claim 29 wherein said m of said $R_c$ is from about 2 to about 3 with no more than one hydroxy group in any $(C(R_c)_2)$ moiety.

33. A process of treating a hard-surface soiled by limescale-containing stains, wherein an acidic liquid composition according to claim 16 is applied in its neat form or in diluted form, onto said surface, then left to act onto said surfaces, and then removed by rinsing.

34. A method comprising the step of contacting a hard-surface with a liquid acidic composition comprising a sulfamic acid, a second acid, and an acid-stable polymer selected from the group consisting of a sulphonated polystyrene polymer, a vinylpyrrolidone homopolymer or copolymer, and mixtures thereof, to remove limescale-containing stains from a hard-surface, whereby long lasting shine is delivered to said surface after it has been first treated with said composition.

35. A method comprising the step of contacting a hard-surface with a liquid acidic composition comprising a sulfamic acid, a second acid, and an acid-stable polymer selected from the group consisting of a sulphonated polystyrene polymer, a vinylpyrrolidone homopolymer or copolymer, and mixtures thereof, suitable for removing limescale-containing stains from a hard-surface, to reduce the formation of limescale deposits on said hard-surface when it comes in contact with water, after said hard-surface has first been treated with said composition.

* * * * *